US011420836B2

(12) United States Patent
Uchida

(10) Patent No.: US 11,420,836 B2
(45) Date of Patent: Aug. 23, 2022

(54) RECORDING MEDIUM CONVEYING DEVICE AND IMAGE FORMING APPARATUS INCORPORATING THE RECORDING MEDIUM CONVEYING DEVICE

(71) Applicant: Eri Uchida, Kanagawa (JP)

(72) Inventor: Eri Uchida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 17/005,261

(22) Filed: Aug. 27, 2020

(65) Prior Publication Data

US 2021/0061600 A1 Mar. 4, 2021

(30) Foreign Application Priority Data

Sep. 4, 2019 (JP) ..... JP2019-161448

(51) Int. Cl.
*B41J 2/045* (2006.01)
*B41J 11/42* (2006.01)
(Continued)

(52) U.S. Cl.
CPC ..... *B65H 5/062* (2013.01); *B41J 2/04505* (2013.01); *B41J 11/0095* (2013.01);
(Continued)

(58) Field of Classification Search
CPC ..... B65H 5/062; B65H 2404/1424; B65H 2553/82; B65H 2557/63; B65H 2404/256;
(Continued)

(56) References Cited

U.S. PATENT DOCUMENTS

2008/0303202 A1* 12/2008 Noguchi ..... G03G 15/657 271/10.06
2017/0075261 A1* 3/2017 Takatsuka ..... G03G 15/6517
(Continued)

FOREIGN PATENT DOCUMENTS

JP 2002103598 A * 4/2002 ..... B41J 11/007
JP 2005-077652 3/2005
(Continued)

OTHER PUBLICATIONS

U.S. Appl. No. 16/819,211, filed Mar. 16, 2020 Eri Uchida.

*Primary Examiner* — Yaovi M Ameh
(74) *Attorney, Agent, or Firm* — Duft & Bornsen, PC

(57) ABSTRACT

A recoding medium conveying device includes a conveyance belt, a first sensor, a second sensor, and circuitry. The conveyance belt has an endless loop shape and a length capable of conveying a plurality of recording media in one rotation. The first sensor is disposed upstream from the conveyance belt in a conveyance direction of a recording medium and is configured to detect the recording medium. The second sensor is configured to detect a home position of the conveyance belt. The circuitry is configured to adjust a rotation speed of the conveyance belt, while the conveyance belt makes one rotation, to eliminate an amount of deviation between a first detection timing of the recording medium detected by the first sensor and a second detection timing of the home position of the conveyance belt detected by the second sensor.

8 Claims, 7 Drawing Sheets

(51) Int. Cl.

| | |
|---|---|
| ***B65H 7/02*** | (2006.01) |
| ***B65H 5/06*** | (2006.01) |
| ***B41J 15/04*** | (2006.01) |
| ***B41J 11/00*** | (2006.01) |

(52) U.S. Cl.
CPC ..... *B41J 11/42* (2013.01); *B41J 15/04* (2013.01); *B65H 7/02* (2013.01); *B65H 2404/1424* (2013.01); *B65H 2553/82* (2013.01); *B65H 2557/63* (2013.01)

(58) Field of Classification Search
CPC ..... B65H 2511/51; B65H 2511/515; B65H 2513/10; B65H 5/021; B65H 7/02; B65H 7/08; B65H 29/16; B41J 2/04505; B41J 15/04; B41J 11/0095; B41J 11/42; B41J 11/007
See application file for complete search history.

(56) References Cited

U.S. PATENT DOCUMENTS

| | | | |
|---|---|---|---|
| 2019/0283998 | A1 | 9/2019 | Uchida et al. |
| 2020/0171816 | A1 | 1/2020 | Katoh et al. |

FOREIGN PATENT DOCUMENTS

| | | |
|---|---|---|
| JP | 2014-035379 | 2/2014 |
| JP | 2019-001160 | 1/2019 |

* cited by examiner

RECORDING MEDIUM CONVEYING DEVICE AND IMAGE FORMING APPARATUS INCORPORATING THE RECORDING MEDIUM CONVEYING DEVICE

CROSS-REFERENCE TO RELATED APPLICATION

This patent application is based on and claims priority pursuant to 35 U.S.C. § 119(a) to Japanese Patent Application No. 2019-161448, filed on Sep. 4, 2019, in the Japan Patent Office, the entire disclosure of which is hereby incorporated by reference herein.

BACKGROUND

Technical Field

This disclosure relates to a recording medium conveying device and an image forming apparatus incorporating the recording medium conveying device.

Background Art

Various types of image forming apparatuses are known to include a conveyance drum that conveys a sheet by rotating at a position where the sheet on the conveyance drum faces an image forming device, and a conveyance belt that is disposed downstream from the conveyance drum in a conveyance direction of the sheet, to convey the sheet on which an image is formed by an image forming device. For example, a known image forming apparatus causes a conveyance drum to rotate in synchrony with rotation of the conveyance belt in order to meet an image forming position or to transfer the sheet between the conveyance drum and the conveyance belt.

Further, in order to eliminate the above-described inconvenience, a known technique is employed to detect the position of a sheet to be conveyed, calculate the difference of the detected value and the target value, and control the conveying speed of the sheet to reach a given position at a given time according to the calculation result. (This control is referred to as a "synchronization control.")

SUMMARY

At least one aspect of this disclosure, a novel recording medium conveying device includes a conveyance belt, a first sensor, a second sensor, and circuitry. The conveyance belt has an endless loop shape and a length capable of conveying a plurality of recording media in one rotation. The first sensor is disposed upstream from the conveyance belt in a conveyance direction of a recording medium. The first sensor is configured to detect the recording medium. The second sensor is configured to detect a home position of the conveyance belt. The circuitry is configured to adjust a rotation speed of the conveyance belt, while the conveyance belt makes one rotation, to eliminate an amount of deviation between a first detection timing of the recording medium detected by the first sensor and a second detection timing of the home position of the conveyance belt detected by the second sensor.

Further, at least one aspect of this disclosure, an image forming apparatus includes the above-described recording medium conveying device and an image forming device configured to form an image on the recording medium conveyed by the recording medium conveying device.

BRIEF DESCRIPTION OF THE SEVERAL VIEWS OF THE DRAWINGS

Exemplary embodiments of this disclosure will be described in detail based on the following figures, wherein.

Figure 1:
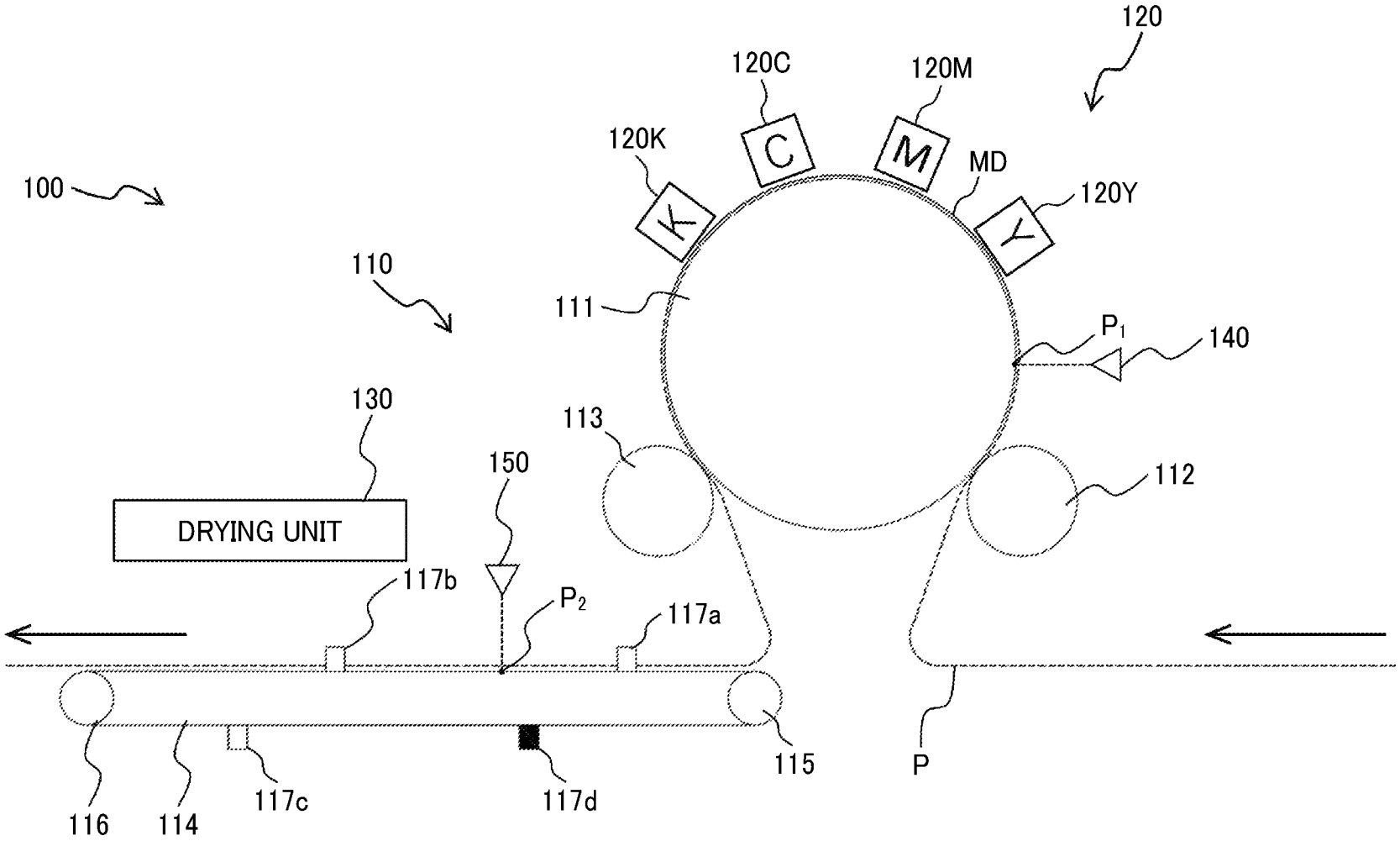
FIG. 1 is a diagram illustrating an internal configuration of an image forming apparatus according to Embodiment 1.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiment 1

Figure 2:
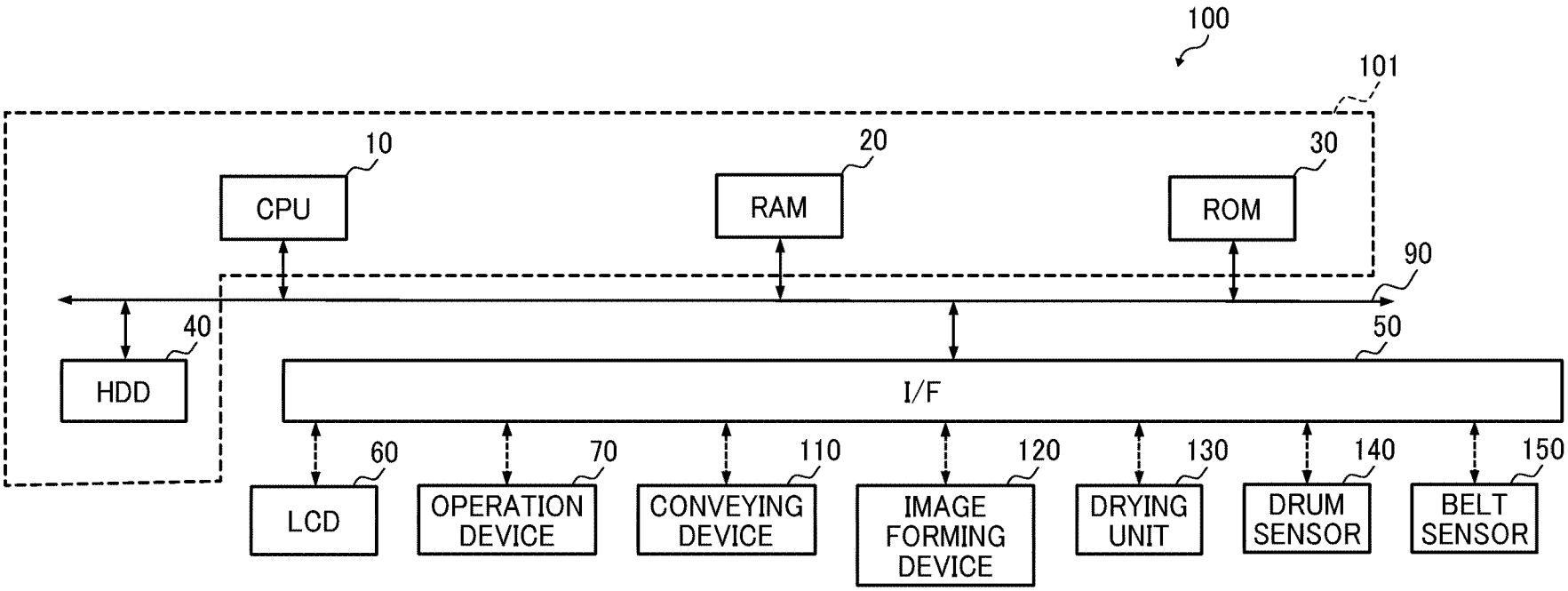
FIG. 2 is a block diagram illustrating a hardware configuration of the image forming apparatus.

Initially with reference to FIGS. 1 and 2, a description is given of an image forming apparatus 100 according to Embodiment 1 of this disclosure.

FIG. 1 is a diagram illustrating an internal configuration of a conveying device 110 and an image forming device 120 provided in the image forming apparatus 100 according to Embodiment 1. FIG. 2 is a block diagram illustrating a hardware configuration of the image forming apparatus 100.

As illustrated in FIGS. 1 and 2, the image forming apparatus 100 includes the conveying device 110, the image forming device 120, and a drying unit 130. In the image forming apparatus 100, the conveying device 110 that functions as a recording medium conveying device conveys a sheet MD (or sheets M) that functions as a recording medium (or recording media), the image forming device 120 forms an image on the sheet MD that is conveyed by the conveying device 110, and the drying unit 130 dries the sheet MD with the image formed by the image forming device 120.

The conveying device 110 conveys the sheet MD contained in a sheet tray to a sheet ejection tray along a conveyance passage P. The conveying device 110 includes a conveyance drum 111, an entrance cylinder 112, an exit cylinder 113, and a conveyance belt 114.

The sheet MD is conveyed through the conveyance passage P that is a space defined by internal components of the image forming apparatus 100. The conveyance passage P runs an area facing the image forming device 120 and the drying unit 130. That is, the sheet MD conveyed by the conveying device 110 in a sheet conveyance direction (indicated by arrow in FIG. 1) in which the sheet MD is conveyed passes through the area facing the image forming device 120 and the drying unit 130.

The conveyance drum 111 is disposed upstream from the conveyance belt 114 in the sheet conveyance direction. Further, the conveyance drum 111 is disposed at a position facing the image forming device 120. The entrance cylinder 112 is disposed upstream from the image forming device 120 in the sheet conveyance direction, where the entrance cylinder 112 contacts the conveyance drum 111. The exit cylinder 113 is disposed downstream from the image forming device 120 and upstream from the conveyance belt 114 in the sheet conveyance direction, where the exit cylinder 113 contacts the conveyance drum 111.

The conveyance drum 111, the entrance cylinder 112, and the exit cylinder 113 rotate while holding the sheet MD, so that the sheet MD is conveyed in the sheet conveyance direction. More specifically, the sheet MD that is fed from the sheet tray is held by the conveyance drum 111 and the entrance cylinder 112 while the conveyance drum 111 and the entrance cylinder 112 are rotating, and then conveyed to the position at which the sheet MD faces the image forming device 120. Further, the sheet MD on which an image is formed by the image forming device 120 is held by the conveyance drum 111 and the exit cylinder 113 while the conveyance drum 111 and the exit cylinder 113 are rotating, and then conveyed (transferred) to the conveyance belt 114.

The conveyance belt 114 is disposed downstream from the conveyance drum 111 and the image forming device 120 in the sheet conveyance direction. Further, the conveyance belt 114 is disposed at a position facing the drying unit 130. The conveyance belt 114 is an endless belt and is stretched between a drive roller 115 and a driven roller 116. As a motor drives to exert a driving force, the driving force is transmitted to the drive roller 115 to rotate. Along with rotation of the drive roller 115, the conveyance belt 114 and the driven roller 116 are rotated. Consequently, the sheet MD that is transferred by the conveyance drum 111 passes by the position facing the drying unit 130 to be ejected to the sheet ejection tray.

Partitions 117*a*, 117*b*, 117*c*, and 117*d* are provided on the surface of the conveyance belt 114 at a plurality of positions that are spaced apart in the circumferential direction of the conveyance drum 111. When the leading end of the sheet MD that is transferred from the conveyance drum 111 contacts the partitions 117*a*, 117*b*, 117*c*, and 117*d*, the partitions 117*a*, 117*b*, 117*c*, and 117*d* prevents slippage of the sheet MD or the positional deviation of the sheet MD. That is, one sheet MD is placed between adjacent partitions of the partitions 117*a*, 117*b*, 117*c*, and 117*d*. In other words, the conveyance belt 114 has an endless loop shape and a length capable of conveying a plurality of sheets M (four sheets in Embodiment 1) in one rotation of the conveyance belt 114.

The image forming device 120 is disposed facing the conveyance drum 111 between the entrance cylinder 112 and the exit cylinder 113. The image forming device 120 discharges ink to the sheet MD that is conveyed by the conveying device 110, so that an image is formed on the sheet MD. The image forming device 120 includes a plurality of recording heads 120K, 120C, 120M, and 120Y that discharge inks of respective colors of K, C, M, and Y.

The recording head 120K discharges black ink, the recording head 120C discharges cyan ink, the recording head 120M discharges magenta ink, and the recording head 120Y discharges yellow ink. However, the combination of colors of inks discharged by the recording heads is not limited to the above-described example. Further, the image forming device 120 is not limited to an image forming device that forms an image by an inkjet image forming method. For example, an image forming device that forms an image by an electrophotographic image forming method may be employed.

The drying unit 130 performs a drying process on the sheet MD conveyed on the conveyance belt 114. The drying process refers to, for example, heating the sheet MD or blowing hot air onto the sheet MD. Accordingly, liquid such as water in the ink that has landed on the sheet MD evaporates. Due to this process, the ink fixedly adheres to the sheet MD and curling of the sheet MD is restrained.

The image forming apparatus 100 further includes a drum sensor 140 (that functions as a first sensor). The drum sensor 140 detects the sheet MD conveyed on the conveyance drum 111 and outputs a detection signal indicating the detection result to the controller 101. The drum sensor 140 includes, for example, a light emitting part that emits light toward a detection position $P_1$ on the conveyance drum 111 and a light receiving part that receives the light reflected on the conveyance drum 111 or the sheet MD.

For example, when the sheet MD is white and the surface of the conveyance drum 111 is black, the reflection light reflected on the sheet MD has the intensity greater than the intensity of the reflection light reflected on the surface of the conveyance drum 111. Therefore, the drum sensor 140 starts outputting the detection signal at a timing at which the intensity of the reflection light received by the light receiving part changes to a value equal to the threshold or greater, and stops outputting the detection signal at a timing at which the intensity of the reflection light received by the light receiving part changes to a value smaller than the threshold. In other words, the drum sensor 140 continues to output the detection signal while the sheet MD is present at the detection position $P_1$.

Note that the drum sensor 140 is not limited to a sensor that directly detects the sheet MD. As another example, the drum sensor 140 may detect the reference position (home position) of the conveyance drum 111. The reference position of the conveyance drum 111 is provided at one position on the conveyance drum 111 in the circumferential direction of the conveyance drum 111. The reference position is, for example, a portion having the reflectance higher than the other portion, on the surface of the conveyance drum 111. That is, the detection signal is output from the drum sensor 140 at the timing when the reference position of the conveyance drum 111 passes the detection position $P_1$.

For example, when the sheet MD is conveyed while constantly contacting a fixed position of the conveyance drum 111 (that is, sheet clip conveyance), in a case in which the drum sensor 140 detects the reference position of the conveyance drum 111, the position of the sheet MD is specified naturally. Similarly, the drum sensor 140 may detect the sheet MD indirectly by detecting the reference position of the entrance cylinder 112 or the exit cylinder 113. As described above, as long as the drum sensor 140 detects the sheet MD upstream from the conveyance belt 114, the detailed configuration of the image forming apparatus 100 is not limited particularly.

The image forming apparatus 100 further includes a belt sensor 150 (that functions as a second sensor). The belt sensor 150 detects a given home position on the conveyance belt 114, and outputs the detection signal indicating the detection result to the controller 101. The home position is hereinafter referred to as the "HP for convenience. The belt sensor 150 includes, for example, a light emitting part that emits light toward a detection position $P_2$ on the conveyance belt 114 and a light receiving part that receives the light reflected on the conveyance belt 114, the plurality of partitions 117*a*, 117*b*, 117*c*, and 117*d* or the sheet MD. The HP is provided at one portion on the conveyance belt 114 in the circumferential direction of the conveyance belt 114. The HP is set to, for example, one of the plurality of partitions 117*a*, 117*b*, 117*c*, and 117*d* (the partition 117*d* in the example of FIG. 1). Further, the partition 117*d* is set to have a light reflectance lower than the conveyance belt 114, the partitions 117*a*, 117*b*, and 117*c*, and the light reflectance of the sheet MD. That is, the reflection light reflected on the surface of the partition 117*d* has the intensity smaller than the intensity of the reflection light reflected on the conveyance belt 114, the partitions 117*a*, 117*b*, and 117*c*, and the sheet MD.

Therefore, the belt sensor 150 starts outputting the detection signal at a timing at which the intensity of the reflection light received by the light receiving part changes to a value smaller than the threshold, and stops outputting the detection signal at a timing at which the intensity of the reflection light received by the light receiving part changes to a value equal to the threshold or greater. In other words, the belt sensor 150 continues to output the detection signal while the partition 117*d* is present at the detection position $P_2$.

The detection position $P_1$ is located upstream from the detection position $P_2$ in the sheet conveyance direction. When the conveyance drum 111 and the conveyance belt 114 are synchronized with each other, the detection positions $P_1$ and $P_2$ are set to respective positions where the leading end of the sheet MD and the HP are detected at the same time. The detection position $P_1$ in Embodiment 1 is located downstream from the entrance cylinder 112 and upstream from the image forming device 120 in the sheet conveyance direction. The detection position $P_2$ in Embodiment 1 is located downstream from the exit cylinder 113 and upstream from the drying unit 130 in the sheet conveyance direction.

Further, as illustrated in FIG. 2, the image forming apparatus 100 includes a central processing unit (CPU) 10, a random access memory (RAM) 20, a read only memory (ROM) 30, a hard disk drive (HDD) 40, and an interface (I/F) 50, which are connected to each other via a common bus 90.

The CPU 10 is a calculator or computing device that controls an overall operation of the image forming apparatus 100. The RAM 20 is a volatile storage medium that allows data to be read and written at high speed. The CPU 10 uses the RAM 20 as a work area for data processing. The ROM 30 is a read-only non-volatile storage medium that stores programs such as firmware. The HDD 40 is a non-volatile storage medium that allows data to be read and written and has a relatively large storage capacity. The HDD 40 stores, e.g., an operating system (OS), various control programs, and application programs.

The image forming apparatus 100 processes, by an arithmetic function of the CPU 10, e.g., a control program stored in the ROM 30 and an information processing program (or application program) loaded into the RAM 20 from a storage medium such as the HDD 40. Such processing configures a software controller including various functional modules of the image forming apparatus 100. The software controller thus configured cooperates with hardware resources of the image forming apparatus 100 construct functional blocks to implement functions of the image forming apparatus 100. Specifically, the CPU 10, the RAM 20, the ROM 30, and the HDD 40 implement the controller 101 that controls the operation of the image forming apparatus 100.

The I/F 50 is an interface that connects a liquid crystal display (LCD) 60, an operation device 70, the conveying device 110, the image forming device 120, the drying unit 130, the drum sensor 140, and the belt sensor 150 to the common bus 90. The LCD 60 is a display that functions as a notification device to display various screens to notify information to, e.g., a user. The operation device 70 is an input interface that receives input of various types of information from the user. The operation device 70 includes a touch panel superimposed on the LCD 60 and a push button.

The controller 101 controls the conveying device 110, the image forming device 120, and the drying unit 130 to execute an image forming process of forming an image on the sheet MD according to image data. That is, the controller 101 drives a motor to convey the sheet MD to the conveying device 110, causes the image forming device 120 to discharge inks at respective given timings, and causes the drying unit 130 to dry the sheet MD.

Further, the controller 101 executes the conveyance deviation correcting process based on the detection signals output from the drum sensor 140 and the belt sensor 150 while executing the image forming process. In a case in which the conveying device 110 conveys a plurality of sheets M sequentially, the conveyance deviation correcting process is performed to correct deviation of the conveyance timing of the sheet MD conveyed by the conveyance drum 111 and the conveyance belt 114.

In the image forming apparatus 100 according to Embodiment 1, in order to place the sheet MD between adjacent partitions of the plurality of partitions 117*a*, 117*b*, 117*c*, and 117*d*, the conveyance drum 111 and the conveyance belt 114 are rotated in synchrony with each other. In other words, as the degree of deviation of the sheet conveyance timing of the sheet MD by the conveyance drum 111 and the conveyance belt 114 increases, the sheet MD is likely to be conveyed while the sheet MD is loaded on the plurality of partitions 117*a*, 117*b*, 117*c*, and 117*d*, resulting in slippage or positional deviation.

Figure 3:
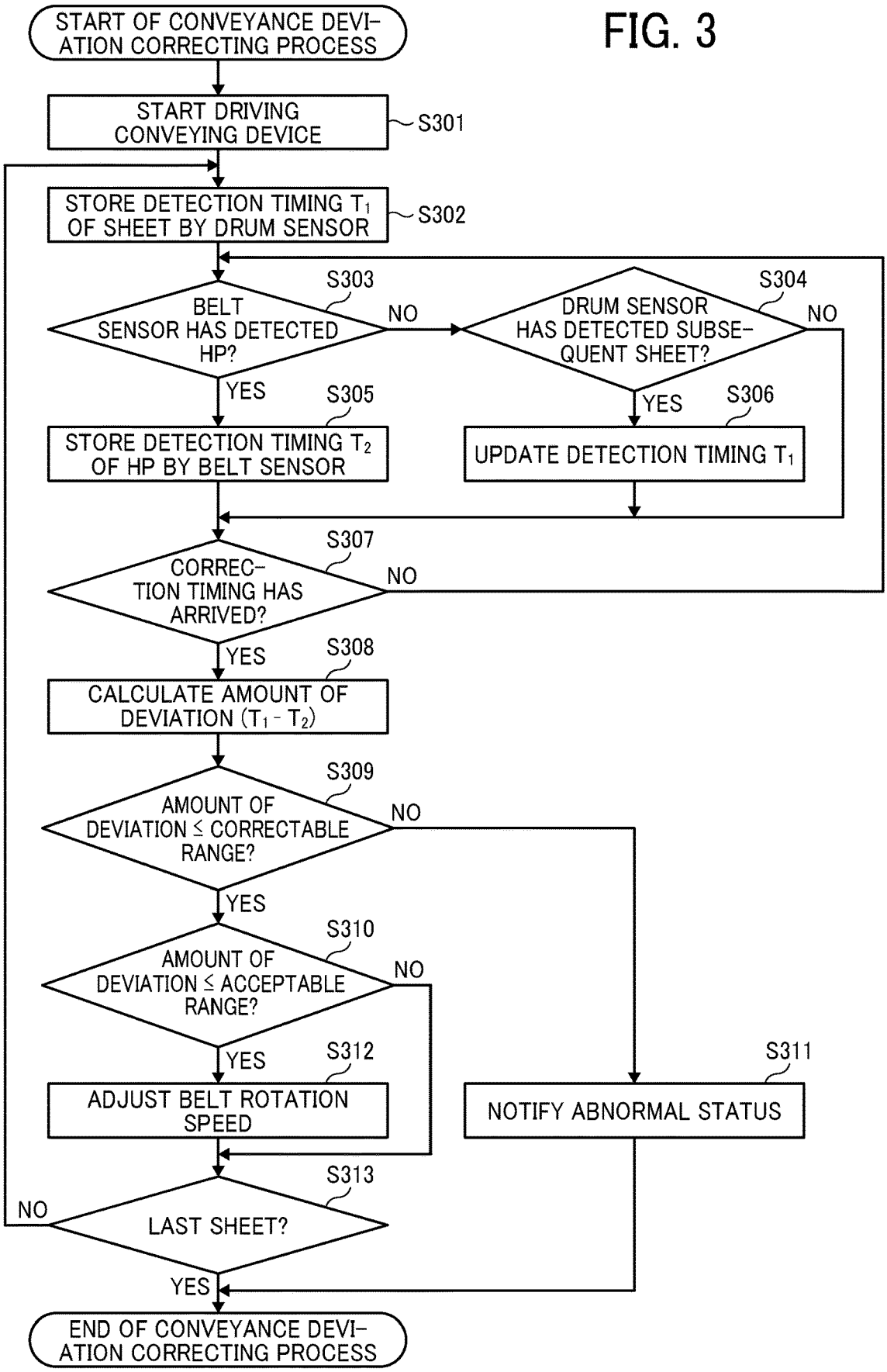
FIG. 3 is a flowchart of a conveyance deviation correcting process.
Figure 4:
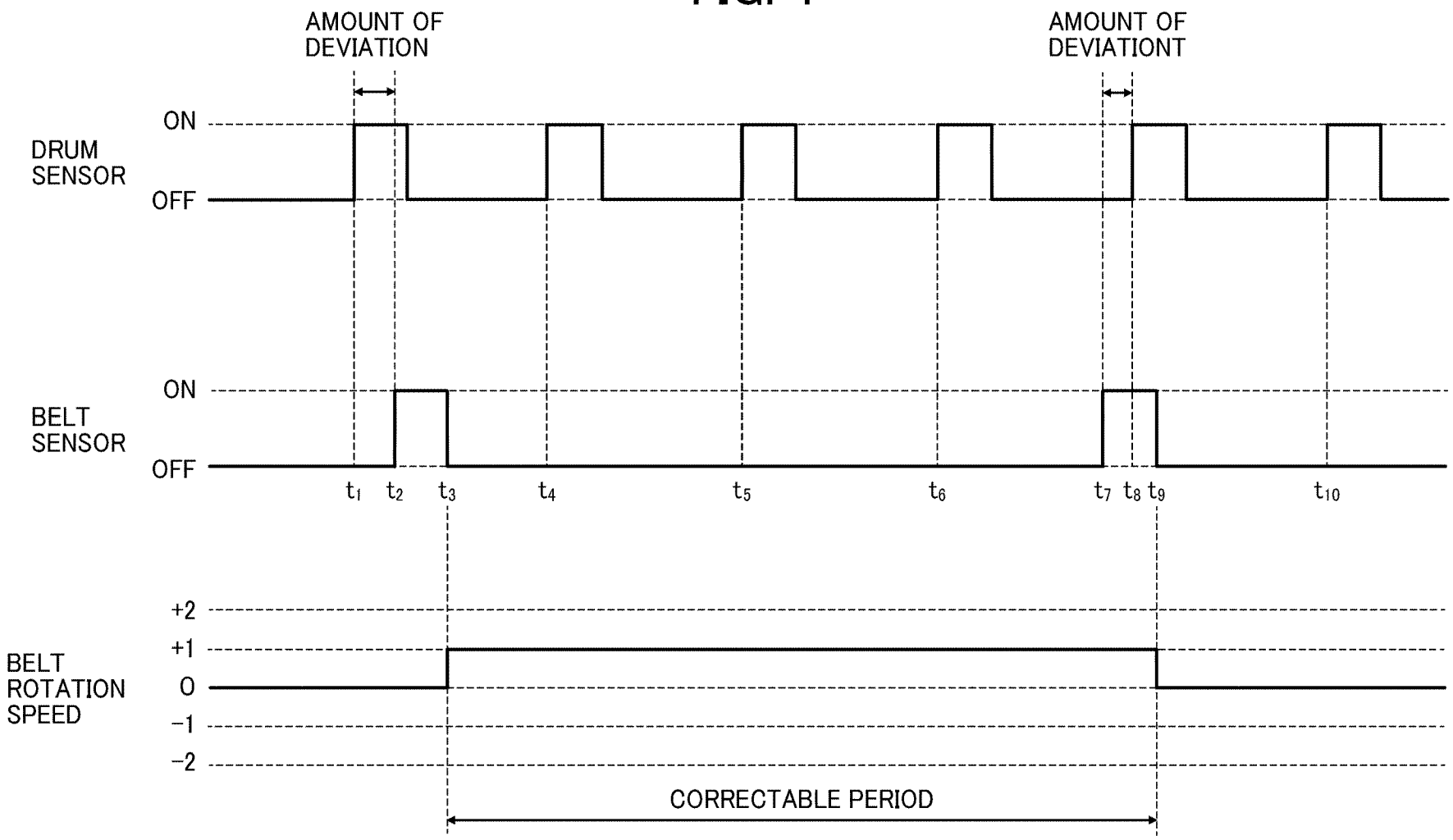
FIG. 4 is a timing diagram illustrating a relation of a drum sensor, a belt sensor, and a belt rotation speed according to Embodiment 1.

FIG. 3 is a flowchart of the conveyance deviation correcting process executed by the controller 101. FIG. 4 is a timing diagram illustrating the relation of the drum sensor 140, the belt sensor 150, and the rotation speed of the conveyance belt 114 according to Embodiment 1. (Hereinafter, the rotation speed of the conveyance belt 114 is referred to as the "belt rotation speed.")

First, the controller 101 starts driving the conveying device 110 (step S301). That is, the controller 101 drives a motor to rotate the conveyance drum 111 and the conveyance belt 114 in step S301. As a result, the sheet MD in the sheet tray is conveyed along the conveyance passage P.

The conveyance belt 114 according to Embodiment 1 has different belt rotation speeds at a plurality of steps (specifically, steps −2, −1, 0, +1, and +2 of the belt rotation speeds in FIG. 4). The different belt rotation speeds in FIG. 4 indicate that the larger number provides a faster rotation speed. That is, the controller 101 selects one step of the plurality of belt rotation speeds to rotate the conveyance belt 114 at the selected step of the belt rotation speed.

In step S301, the controller 101 rotates the conveyance belt 114 at the step 0. On the other hand, the controller 101 continuously rotates the conveyance drum 111 at a constant rotation speed. Ideally, with this configuration, the conveyance drum 111 and the conveyance belt 114 rotate in synchrony with each other. However, in reality, rotation of the conveyance drum 111 and rotation of the conveyance belt 114 may deviate from each other due to, for example, transmission error of the driving force of the motor (such as the backlash of gear) and bending of conveyance belt 114.

The drum sensor 140 detects the sheet MD that is conveyed along the conveyance passage P. Then, the controller 101 stores the time $t_1$ (see FIG. 4) that is a time when the drum sensor 140 detects the leading end of the sheet MD, in the RAM 20, as a first detection timing $T_1$ (step S302). Further, the controller 101 causes the image forming device 120 to discharge ink at a given timing, so that an image is formed on the sheet MD.

Next, the controller 101 monitors the detection signals output from the belt sensor 150 (step S303) and the drum sensor 140 (step S304) until the correction timing arrives (S307). To be more specific, the controller 101 determines whether the belt sensor 150 has detected the HP (step S303). When the belt sensor 150 has not detected the HP (NO in step S303), the controller 101 determines whether the drum sensor 140 has detected a subsequent sheet MD (step S304). When the drum sensor 140 has not detected a subsequent sheet MD (NO in step S304), the controller 101 determines whether the correction timing has arrived (step S307). When the correction timing has not yet arrived (NO in step S307), the process returns to step S303, and the controller 101 keeps monitoring the detection signals output from the belt sensor 150 and the drum sensor 140 until arrival of the correction timing.

The correction timing according to Embodiment 1 is, for example, a timing when the partition 117*d*, which is the HP on the conveyance belt 114, has finished passing the detection position $P_2$. That is, in Embodiment 1, the timing at which the output of the detection signal from the belt sensor 150 is stopped (the time $t_3$ and the time $t_9$ in FIG. 4) is the correction timing. However, the specific example of the correction timing is not limited to the above-described example and may be any timing as long as the timing arrives each time the conveyance belt 114 makes one rotation.

Then, when the belt sensor 150 has detected the HP and output the detection signal before arrival of the correction timing (YES in step S303), the controller 101 stores the output time $t_2$ of the detection signal (see FIG. 4), in the RAM 20, as the second detection timing $T_2$ (step S305). Further, when the drum sensor 140 has detected a subsequent sheet MD and output the detection signal before arrival of the correction timing (YES in step S304), the controller 101 stores a new set value of the first detection timing $T_1$ to update the output time $t_4$ of the detection signal, in other words, update the first detection timing $T_1$ (see FIG. 4) (step S306).

Next, when the correction timing has arrived (YES in step S307), the controller 101 calculates an amount of deviation ($T_1$−$T_2$) that digitizes the deviation between the first detection timing $T_1$ and the second detection timing $T_2$ (step S308). Then, the controller 101 compares the calculated amount of deviation between the first detection timing $T_1$ and the second detection timing $T_2$ with a given correctable range (step S309) and an acceptable range (step S310). To be more specific, when the controller 101 checks and confirms that the calculated amount of deviation is within the correctable range (YES in step S309), the controller 101 then compares the calculated amount of deviation with the acceptable range (step S310).

The correctable range is a limit range (including an upper limit value and a lower limit value) of the amount of deviation that is correctable by the conveyance deviation correcting process. In other words, the correctable range is the limit range of the amount of deviation that may be corrected while the conveyance belt 114 makes one rotation. The acceptable range is a range (including an upper limit value and a lower limit value) of acceptable error of the sheet conveyance timing. That is, in a case in which the amount of deviation is within the acceptable range, the sheet MD that is transferred from the conveyance drum 111 to the conveyance belt 114 is placed between adjacent partitions of the partitions 117*a*, 117*b*, 117*c*, and 117*d*.

Then, when the amount of deviation is greater than (beyond) the correctable range (NO in step S309), the controller 101 notifies (informs) the abnormal status of the conveying device 110 (that is, that the amount of deviation exceeds the correctable range in the conveyance deviation correcting process) to an operator via the LCD 60 (step S311). The method of notifying the abnormal status is not limited to displaying a message on the LCD 60 but may be outputting a warning sound through a speaker. Consequently, the controller 101 terminates (ends) the conveyance deviation correcting process without performing the operation in step S312 and subsequent steps.

When the amount of deviation is within the correctable range (YES in step S309) and within the acceptable range (NO in step S310), the controller 101 skips the operations in steps S311 and S312 and determines whether the last sheet MD is conveyed (in other words, the full sheets M are conveyed) (step S313). When the last sheet MD is not conveyed (NO in step S313), the controller 101 returns to step S302 to execute the operations from step S302 and the subsequent steps again. By contrast, when the last sheet MD is conveyed (YES in step S313), the controller 101 finishes (ends) the conveyance deviation correcting process.

Further, when the amount of deviation is within the correctable range (YES in step S309) and is greater than the acceptable range (YES in step S310), the controller 101 adjusts the belt rotation speed so that the amount of deviation is brought closer to zero (0) (step S312). Then, the controller 101 executes the operation of step S313 (and the subsequent steps if the result is NO in step S313) while the conveyance belt 114 is rotated at the belt rotation speed after adjustment.

That is, when the first detection timing $T_1$ is earlier than the second detection timing $T_2$ ($T_1<T_2$) as the time $t_2$ in FIG. 4, the controller 101 increases the belt rotation speed by one step (i.e., the controller 101 changes the step 0 to +1). Then, the controller 101 continues to rotate the conveyance belt 114 at the increased belt rotation speed until the subsequent correction timing arrives and the controller 101 executes steps S308 to S312.

Next, when the first detection timing $T_1$ is later than the second detection timing $T_2$ ($t_8>t_7$) as at the time $t_9$ in FIG. 4, the controller 101 decreases the belt rotation speed by one stage (i.e., the controller 101 changes the step +1 to 0). Then, the controller 101 continues to rotate the conveyance belt 114 at the decreased belt rotation speed until the subsequent correction timing arrives and the controller 101 executes steps S308 to S312.

On the other hand, when the first detection timing $T_1$ is earlier than the second detection timing $T_2$ ($T_1<T_2$) as at the time $t_9$ in FIG. 4, the controller 101 further increases the belt rotation speed by one step (i.e., the controller 101 changes the step +1 to +2). Further, when the amount of deviation is within the acceptable range at the time $t_9$ in FIG. 4 (NO in step S310), the controller 101 maintains the current belt rotation speed (i.e., the step +1).

That is, the controller 101 according to Embodiment 1 repeatedly executes the process of adjusting the belt rotation speed according to the relation of the first detection timing $T_1$ and the second detection timing $T_2$ (steps S308 to S312) each time the correction timing arrives (that is, each time the conveyance belt 114 makes one rotation). Then, the controller 101 executes the process of adjusting the belt rotation speed (steps S308 to S312) to adjust the belt rotation speed of the conveyance belt 114, so as to eliminate the deviation between the first detection timing $T_1$ and the second detection timing $T_2$.

According to Embodiment 1, the following operational effects, for example, are achieved.

According to Embodiment 1, the amount of deviation is brought close to zero (0) over a period in which the conveyance belt 114 makes one rotation (hereinafter, referred to as a "correctable period"). Therefore, when compared with a case in which the amount of deviation is corrected in a period in which a single sheet MD is conveyed, the correctable period increases, and therefore the change in the belt rotation speed is reduced.

As a result, the process performed in Embodiment 1 prevents inconveniences, for example, that the belt rotation speed is too fast to dry the sheet MD fully or that the belt rotation speed is too slow to overdry the sheet MD. That is, by changing the belt rotation speed, an adverse effect on the operation performed by another unit (i.e., the drying unit 130) is restrained.

Further, according to Embodiment 1, each time the conveyance belt 114 makes one rotation, the belt rotation speed is adjusted. Therefore, an abrupt change in the belt rotation speed is prevented. As a result, the adverse effect on the operation of another unit is restrained.

Further, according to Embodiment 1, the belt rotation speed is not changed when the amount of deviation is within the acceptable range. As a result, Embodiment 1 prevents adverse effect on the operation of another unit in correction of a slight deviation in synchronization when such correction is not needed. On the other hand, according to Embodiment 1, when the amount of deviation exceeds (is greater than) the correctable range, the abnormal status of the conveying device 110 is notified (informed) to the operator. By so doing, good maintenance of the image forming apparatus 100 is encouraged.

Embodiment 2

Figure 5:
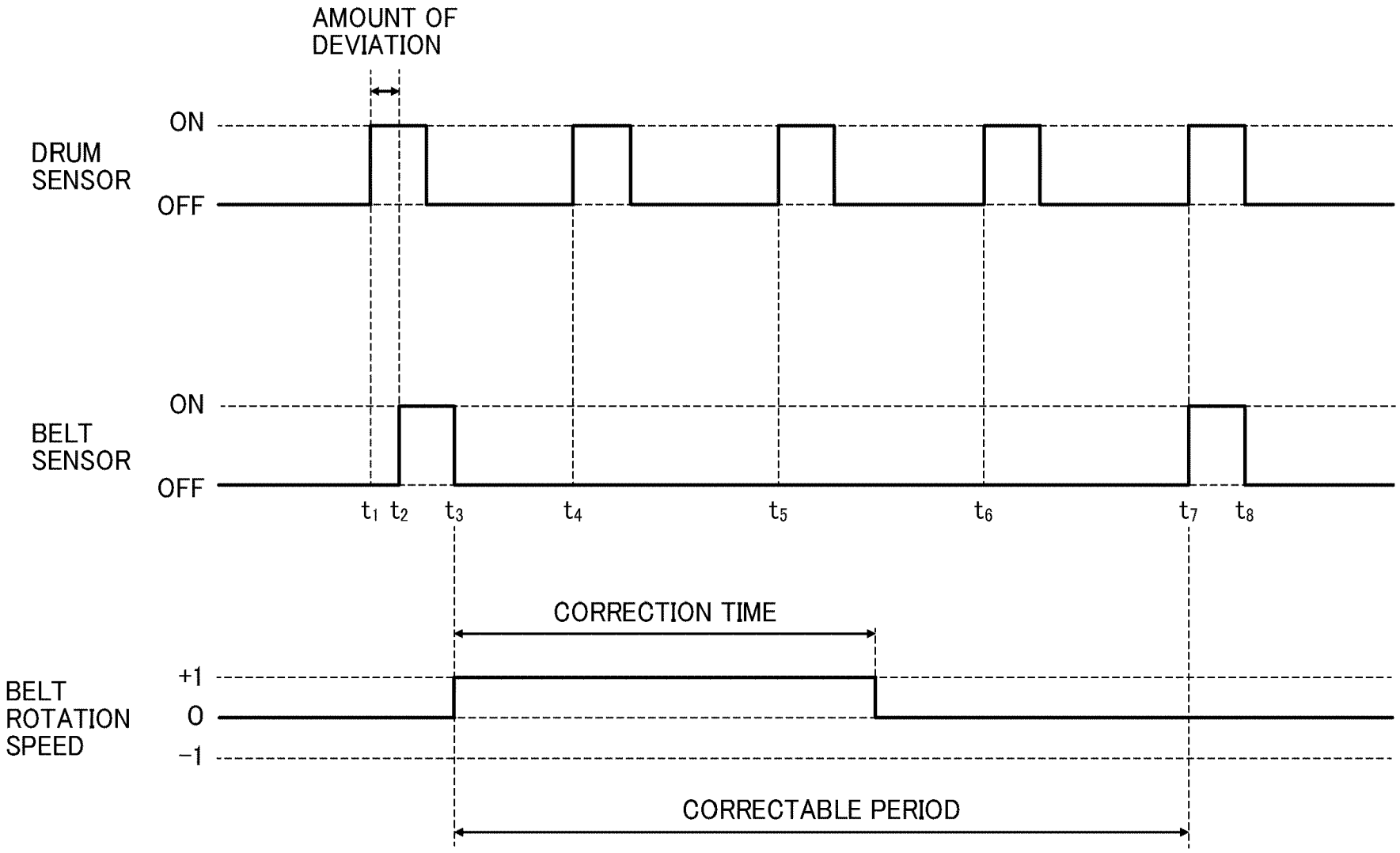
FIG. 5 is a timing diagram illustrating an example of adjustment of the belt rotation speed when a first detection timing is earlier than a second detection timing.
Figure 6:
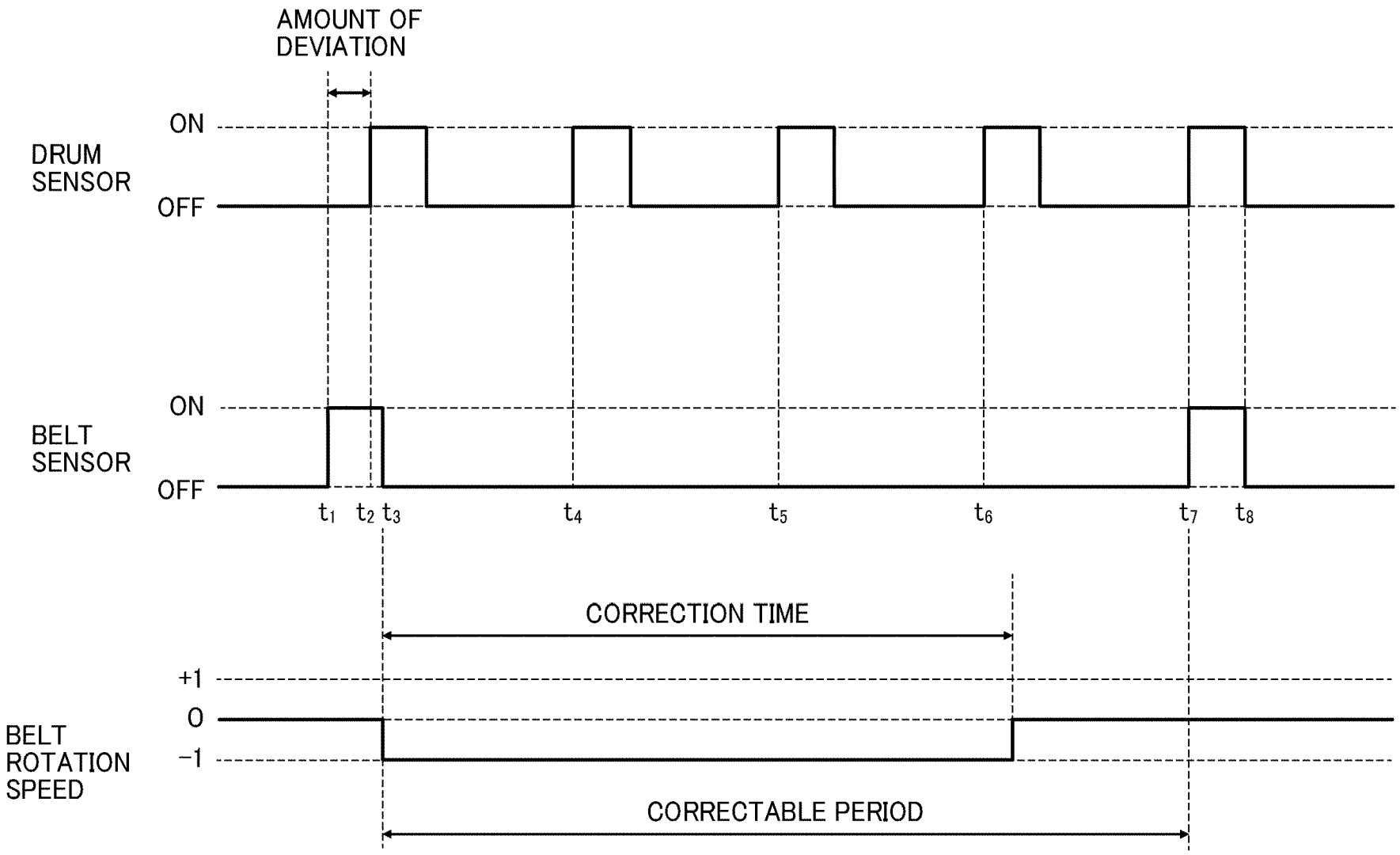
FIG. 6 is a timing diagram illustrating an example of adjustment of the belt rotation speed when the first detection timing is later than the second detection timing.

Next, a description is given of a conveyance deviation correcting process according to Embodiment 2, with reference to FIGS. 5 and 6.

FIG. 5 is a timing diagram illustrating an example of adjustment of the belt rotation speed when the first detection timing $T_1$ is earlier than the second detection timing $T_2$. FIG. 6 is a timing diagram illustrating an example of adjustment of the belt rotation speed when the first detection timing $T_1$ is later than the second detection timing $T_2$.

Note that the detailed description of the conveyance deviation correcting process common to Embodiment 1 is omitted and the description of Embodiment 2 different from Embodiment 1 is given. In Embodiment 2, the operations of the conveyance deviation correcting process are basically same as the operations in Embodiment 1, except for the detailed method of adjusting the belt rotation speed in step S312 in FIG. 3.

The conveyance belt 114 according to Embodiment 2 rotates at any of a reference rotation speed (step 0 in FIG. 5), a high rotation speed that is faster than the reference rotation speed by a given first fixed value (step +1 in FIG. 5), and a low rotation speed that is slower than the reference rotation speed by a given second fixed value (step −1 in FIG. 5). The first fixed value and the second fixed value may be the same values or the different values.

The controller 101 according to Embodiment 2 determines a correction time in step S308. The correction time is a time in which the belt rotation speed is adjusted (increased or decreased). The correction time is determined according to the calculated amount of deviation. More specifically, the correction time becomes longer as the amount of deviation increases, and the correction time becomes shorter as the amount of deviation decreases. That is, the correction time has a positive correlation (typically, a proportional relation) with the amount of deviation. However, the correction time is shorter than the correctable period (that is, the period taken for the conveyance belt 114 to make one rotation).

Then, as illustrated in FIG. 5, when the first detection timing $T_1$ ($t_1$) is earlier than the second detection timing $T_2$ ($t_2$), the controller 101 changes the belt rotation speed from the reference rotation speed to the high rotation speed (that is, increases the belt rotation speed by the first fixed value). When the correction time determined in step S308 elapses, the controller 101 changes the belt rotation speed back to the reference rotation speed.

On the other hand, as illustrated in FIG. 6, when the first detection timing $T_1$ ($t_2$) is later than the second detection timing $T_2$ ($t_1$), the controller 101 changes the belt rotation speed from the reference rotation speed to the low rotation speed (that is, decreases the belt rotation speed by the second fixed value). When the correction time determined in step S308 elapses, the controller 101 changes the belt rotation speed back to the reference rotation speed.

According to Embodiment 2, the correction time is increased or decreased according to the degree of the amount of deviation (the absolute value), the deviation in conveyance of conveyance drum 111 and conveyance belt 114 is adjusted more flexibly. Note that the process in step S310 in FIG. 3 may be omitted in Embodiment 2.

Embodiment 3

Figure 7:
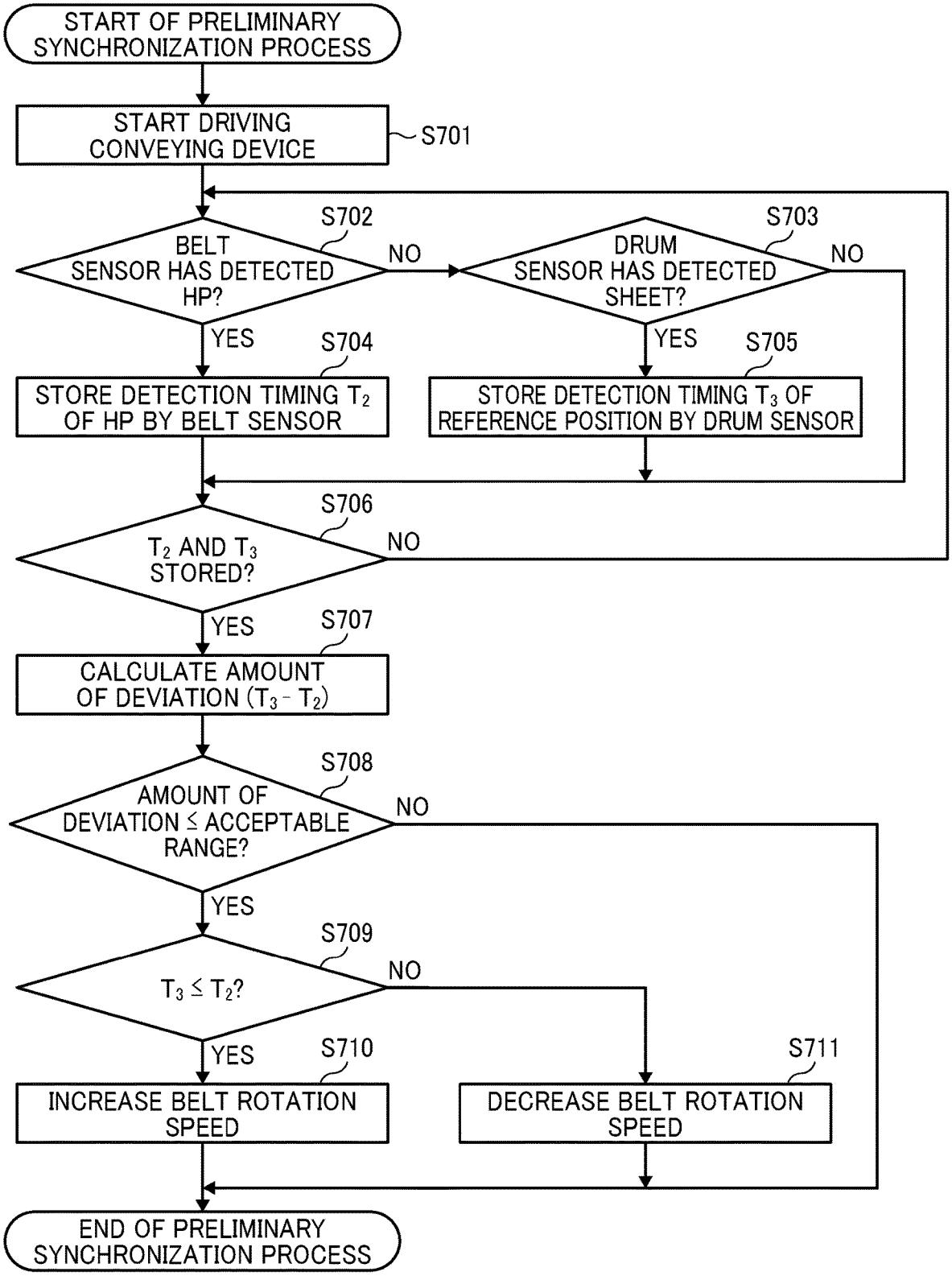
FIG. 7 is a flowchart of a preliminary synchronization process.

Next, a description is given of a preliminary synchronization process according to Embodiment 3 of this disclosure, with reference to FIG. 7.

FIG. 7 is a flowchart of the preliminary synchronization process according to Embodiment 3. Note that, in the following description of Embodiment 3, the detailed descriptions sharing with Embodiments 1 and 2 are omitted and the features different from Embodiments 1 and 2 are given.

The configuration of the image forming apparatus 100 according to Embodiment 3 is basically same as the configuration according to Embodiment 1 and the configuration according to Embodiment 2, except that the reference position of the conveyance drum 111 is detectable by the drum sensor 140 in Embodiment 2.

The reference position of the conveyance drum 111 is provided at one position on the conveyance drum 111 in the circumferential direction of the conveyance drum 111. The reference position is, for example, a portion having the reflectance higher than the other portion, on the surface of the conveyance drum 111. That is, the detection signal is output from the drum sensor 140 at the timing when the reference position of the conveyance drum 111 passes the detection position $P_1$.

Further, the controller 101 according to Embodiment 3 is basically common to the controller 101 according to Embodiment 1 and the controller 101 according to Embodiment 2, except that the controller 101 according to Embodiment 3 executes the preliminary synchronization process in the flowchart of FIG. 7, in step S301 in FIG. 3. The preliminary synchronization process is a process of synchronizing rotations of the conveyance drum 111 and the conveyance belt 114 before an image is formed on the sheet MD by the image forming device 120.

First, the controller 101 according to Embodiment 3 starts driving the conveying device 110 (step S701). The process of step S701 is common to the process of step S301. However, the sheet MD fed from the sheet tray is not supposed to reach the conveyance drum 111 before the preliminary synchronization process is completed (in other words, the conveyance belt 114 makes two rotations at the maximum).

Next, the controller 101 repeatedly executes the processes of steps S702 to S705 until the second detection timing $T_2$ and the third detection timing $T_3$ are specified (NO in step S706). That is, the controller 101 stores the output time of the detection signal from the belt sensor 150 (the detection time of the HP) in the RAM 20, as the second detection timing $T_2$ (YES in step S702 to step S704). Further, the controller 101 stores the output time of the detection signal from the drum sensor 140 (the detection time of the reference position) in the RAM 20, as the third detection timing $T_3$ (YES in step S703 to step S705).

Next, when the second detection timing $T_2$ and the third detection timing $T_3$ are specified (YES in step S706), the controller 101 calculates an amount of preliminary deviation ($T_3$−$T_2$) (step S707). Next, the controller 101 compares the calculated amount of preliminary deviation with the acceptable range (step S708). In other words, the controller 101 determines whether the amount of preliminary deviation is within (smaller than) the acceptable range. The acceptable range in step S708 may be the same as the acceptable range in step S310 in the flowchart of FIG. 3 or different from the acceptable range in step S310 in the flowchart of FIG. 3.

Then, when the amount of preliminary deviation calculated in step S707 exceeds (is greater than) the acceptable range (YES in step S708), the controller 101 adjusts the belt rotation speed to bring the amount of preliminary deviation close to zero (0) (steps S709 to S711).

That is, when the third detection timing $T_3$ is earlier than the second detection timing $T_2$ (YES in step S709), the controller 101 increases the belt rotation speed by one step (step S710). The process of step S710 may be the same as the process performed in Embodiment 1 or Embodiment 2 when the first detection timing $T_1$ is earlier than the second detection timing $T_2$.

On the other hand, when the third detection timing $T_3$ is later than the second detection timing $T_2$ (NO in step S709), the controller 101 decreases the belt rotation speed by one step (step S711). The process of step S711 may be the same as the process performed in Embodiment 1 or Embodiment 2 when the first detection timing $T_1$ is later than the second detection timing $T_2$.

Next, when the amount of preliminary deviation falls within the acceptable range (preferably, the amount of preliminary deviation is 0) by performing step S710, step S711, or both, the controller 101 changes the conveying speed of the conveyance belt 114 back to the reference speed (step 0), and completes (ends) the preliminary synchronization process. On the other hand, when the amount of preliminary deviation calculated in step S707 falls within the acceptable range (NO in step S708), the controller 101 skips the operations in steps S709 to step S711 and completes (ends) the preliminary synchronization process.

Then, after completion of the preliminary synchronization process, the controller 101 starts the processes from step S302 in the flowchart of FIG. 3. That is, in Embodiment 3, the image forming device 120 forms an image on the sheet MD after completion of the preliminary synchronization process.

According to Embodiment 3, the image forming device 120 starts forming an image on the sheet MD while rotation of conveyance drum 111 is synchronized with rotation of conveyance belt 114, and therefore the amount of change of the belt rotation speed in conveyance deviation correcting process is reduced As a result, the adverse effect on the operation of another unit is further restrained.

Further, since the preliminary synchronization process according to Embodiment 3 finishes (ends) before the sheet MD fed from the sheet tray reaches conveyance drum 111, the warm-up time of the image forming apparatus 100 is not affected, and rotations of the conveyance drum 111 and the conveyance belt 114 are synchronized with each other.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A recording medium conveying device comprising:

a conveyance belt having an endless loop shape and a length capable of conveying a plurality of recording media in one rotation;

a first sensor disposed upstream from the conveyance belt in a conveyance direction of a recording medium, the first sensor configured to detect the recording medium;

a second sensor configured to detect a home position of the conveyance belt; and circuitry configured to adjust a rotation speed of the conveyance belt, while the conveyance belt makes one rotation, to eliminate an amount of deviation between a first detection timing of the recording medium detected by the first sensor and a second detection timing of the home position of the conveyance belt detected by the second sensor.

2. The recording medium conveying device according to claim 1, wherein the conveyance belt is configured to rotate at a plurality of steps of different belt rotation speeds, and wherein, for each rotation of the conveyance belt, the circuitry is configured to:

increase the rotation speed of the conveyance belt by one step, when the first detection timing is earlier than the second detection timing; and decrease the rotation speed of the conveyance belt by one step, when the first detection timing is later than the second detection timing.

3. The recording medium conveying device according to claim 1, wherein the circuitry is configured to:

increase the rotation speed of the conveyance belt by a first fixed value to an increased rotation speed and lengthen a time in which the conveyance belt is rotated at the increased rotation speed as the amount of deviation is greater, when the first detection timing is earlier than the second detection timing; and decrease the rotation speed of the conveyance belt by a second fixed value to a decreased rotation speed and lengthen a time in which the conveyance belt is rotated at the decreased rotation speed as the amount of deviation is greater, when the first detection timing is later than the second detection timing.

4. The recording medium conveying device according to claim 1, wherein the circuitry is configured to adjust the rotation speed of the conveyance belt when the amount of deviation is beyond an acceptable range.

5. The recording medium conveying device according to claim 1, further comprising a notification device, wherein the circuitry is configured to cause the notification device to notify an abnormal status when the amount of deviation is beyond a correctable range.

6. The recording medium conveying device according to claim 1, further comprising a conveyance drum configured to convey the recording medium toward the conveyance belt, wherein the circuitry is configured to:

calculate an amount of preliminary deviation between a third detection timing of a home position of the conveyance drum detected by the first sensor and the second detection timing; and adjust the rotation speed of the conveyance belt to bring the amount of preliminary deviation close to zero, while the conveyance belt makes one rotation.

7. An image forming apparatus comprising:

the recording medium conveying device according to claim 1; and an image forming device configured to form an image on the recording medium conveyed by the recording medium conveying device.

8. The image forming apparatus according to claim 7, further comprising a drying unit disposed at a position facing the conveyance belt, the drying unit configured to dry the recording medium on the conveyance belt.

* * * * *